US010068409B2

(12) United States Patent
Ohkubo

(10) Patent No.: US 10,068,409 B2
(45) Date of Patent: Sep. 4, 2018

(54) VENDING MACHINE

(75) Inventor: Masaru Ohkubo, Isesaki (JP)

(73) Assignee: Sanden Holdings Corporation, Isesaki-shi, Gunma (JP)

( * ) Notice: Subject to any disclaimer, the term of this patent is extended or adjusted under 35 U.S.C. 154(b) by 1023 days.

(21) Appl. No.: 14/009,036

(22) PCT Filed: Mar. 29, 2012

(86) PCT No.: PCT/JP2012/058311
§ 371 (c)(1),
(2), (4) Date: Sep. 30, 2013

(87) PCT Pub. No.: WO2012/133619
PCT Pub. Date: Oct. 4, 2012

(65) Prior Publication Data

US 2014/0197191 A1 Jul. 17, 2014

(30) Foreign Application Priority Data

Mar. 30, 2011 (JP) ..... 2011-074895

(51) Int. Cl.
*G07F 11/42* (2006.01)
*G07F 11/16* (2006.01)

(52) U.S. Cl.
CPC ..... *G07F 11/42* (2013.01); *G07F 11/165* (2013.01)

(58) Field of Classification Search
CPC ..... G07F 9/006; G07F 11/42; G07F 11/165
See application file for complete search history.

(56) References Cited

U.S. PATENT DOCUMENTS 4,108,333 A * 8/1978 Falk ..... G07F 9/105 198/817
2011/0226795 A1* 9/2011 Sichich ..... G07F 11/165 221/1

FOREIGN PATENT DOCUMENTS

JP 2002-092712 A 3/2002

OTHER PUBLICATIONS

Japanese Patent Office, International Search Report for International Application No. PCT/JP2012/058311, dated Apr. 24, 2012.

* cited by examiner

*Primary Examiner* — Gene O Crawford
*Assistant Examiner* — Kelvin L Randall, Jr.
(74) *Attorney, Agent, or Firm* — Baker Botts L.L.P.

(57) ABSTRACT

There is provided a vending machine that prevents a commodity receptacle from being damaged and a commodity from slipping out thereof by a shock due to falling even if a commodity receptacle undergoes free fall without requiring a complicated structure for preventing the commodity receptacle from undergoing free fall. When it is detected that the fall velocity of a bucket 60 falling due to disconnection of power supply to a second motor 72*a* of a bucket moving mechanism 70 is equal to or greater than a predetermined speed, a braking force for decelerating the fall velocity of the bucket 60 is intermittently generated and thereby the bucket 60 can be lowered to the lowest point at a speed slower than free fall. This configuration prevents the bucket 60 from being damaged and a commodity from slipping out thereof by a shock due to falling and does not require a complicated structure for preventing the bucket 60 from undergoing free fall. Additionally, the bucket 60 is not locked, and thus the bucket 60 can be manually moved during maintenance work for restarting the vending operation.

7 Claims, 6 Drawing Sheets

VENDING MACHINE

The present application is a U.S. National Stage Patent Application under 37 U.S.C. § 371 of International Application PCT/JP2012/058311, which was filed on Mar. 29, 2012, and claims priority to and the benefit of Japanese Application No. JP-2011-074895, which was filed on Mar. 30, 2011, the disclosures of which are incorporated herein by reference in their entirety.

TECHNICAL FIELD

The present invention relates to a vending machine for dispensing bottled, canned, or PET bottled beverages, a variety of foodstuffs, and the like.

BACKGROUND ART

Conventionally, as such a vending machine, there has been known a vending machine that includes a plurality of commodity columns arranged at least in a vertical direction of a vending machine body; a commodity receptacle capable of receiving the commodity from a commodity column; and a moving mechanism that moves the commodity receptacle in the vertical direction by a motor, wherein the moving mechanism moves the commodity receptacle to any commodity column, the commodity receptacle receives the commodity from the commodity column, the moving mechanism moves the commodity receptacle having received the commodity to a commodity take-out port, and the commodity is delivered to the commodity take-out port from the commodity receptacle (for example, see Patent document 1).

Note that in the above-described vending machine, for example, when the commodity receptacle is to receive the commodity from the commodity column, if the commodity is received by the commodity receptacle in an incomplete state or the commodity is not received by the commodity receptacle and falls; and such an abnormal condition is detected, the power supply to the motor of the moving mechanism is stopped to suspend the vending operation.

CITATION LIST

Patent Document

Patent document 1: Japanese Patent. No. 4403650

SUMMARY OF INVENTION

Technical Problem

However, as described above, when the power supply to the motor is stopped in response to error detection, the motor is idly rotated due to weight of the commodity receptacle and the commodity receptacle undergoes free fall. This results in a problem in that when the commodity receptacle falls to the lowest point due to free fall, the resulting shock may cause damage to the commodity receptacle or its surrounding mechanism, or if a commodity is placed in the commodity receptacle, the commodity may slip out thereof by a shock due to the fall.

In light of this, when the power supply to the motor is stopped in response to error detection, the commodity receptacle can be prevented from undergoing free fall by locking the commodity receptacle so as not to move in a vertical direction, but locking the commodity receptacle causes a problem of reducing workability since the commodity receptacle cannot be manually moved during maintenance work for restarting the vending operation. However, unlocking the commodity receptacle causes a problem in that the commodity receptacle begins to free fall and thus the commodity receptacle needs to be supported; otherwise, the commodity receptacle will fall down.

Note that even if the power supply to the motor is stopped, the commodity receptacle may not undergo free fall by providing a weight to balance the commodity receptacle. But in this case, the structure is complicated by the space for the weight, causing a problem of an increase in manufacturing costs and an increase in installation space. Further, if a weight is provided to balance the commodity receptacle, the commodity receptacle having a commodity therein may undergo free fall by the weight of the commodity, thus causing a problem in that the commodity receptacle falling cannot be reliably prevented.

In view of the above problems, the present invention has been made, and an object of the present invention is to provide a vending machine that prevents a commodity receptacle from being damaged and a commodity from slipping out thereof by a shock due to falling even if a commodity receptacle undergoes free fall without requiring a complicated structure for preventing the commodity receptacle from undergoing free fall.

Solution to Problem

In order to achieve the above object, the present invention is provided with: a plurality of commodity columns arranged in a vertical direction of a vending machine body; a commodity receptacle capable of receiving a commodity from a commodity column; and a moving mechanism for moving the commodity receptacle in the vertical direction by a motor, wherein the moving mechanism moves the commodity receptacle to any commodity column, the commodity receptacle receives the commodity from the commodity column, the moving mechanism moves the commodity receptacle having received the commodity to a commodity take-out port, and the commodity is delivered to the commodity take-out port from the commodity receptacle, the vending machine including: a fall velocity detection means of detecting a fall velocity of the commodity receptacle falling due to disconnection of power supply to the motor of the moving mechanism; a braking force generating means of generating a braking force for decelerating the fall velocity of the commodity receptacle; and a control unit of causing the braking force generating means to intermittently or continuously generate the braking force when the fall velocity detection means detects that the fall velocity of the commodity receptacle is equal to or greater than a predetermined speed.

Thus, when it is detected that the fall velocity of the commodity receptacle is equal to or greater than the predetermined speed, the braking force for decelerating the fall velocity of the commodity receptacle is intermittently or continuously generated, resulting in that the commodity receptacle is lowered to the lowest point at a speed slower than free fall.

Advantageous Effects of Invention

The present invention has an advantage in that the commodity receptacle falling due to disconnection of power supply to the motor of the moving mechanism can be lowered to the lowest point at a speed slower than free fall, thereby preventing the commodity receptacle from being damaged and a commodity from slipping out thereof by a shock due to falling without requiring a complicated structure for preventing the commodity receptacle from undergoing free fall. The present invention also has an advantage in that the commodity receptacle is not locked, and thus the commodity receptacle can be manually moved during maintenance work for restarting the vending operation, thereby preventing workability from being reduced.

DESCRIPTION OF EMBODIMENTS

Figure 1:
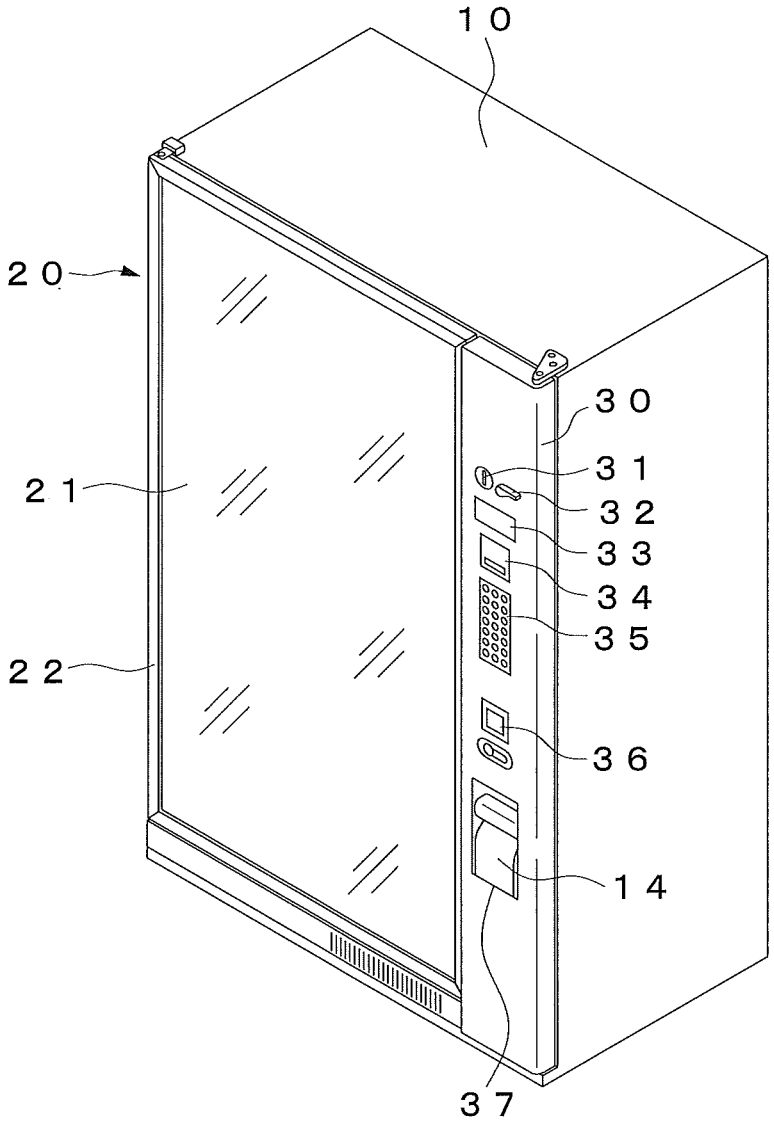
FIG. 1 is a perspective view of a vending machine illustrating an embodiment of the present invention.
Figure 2:
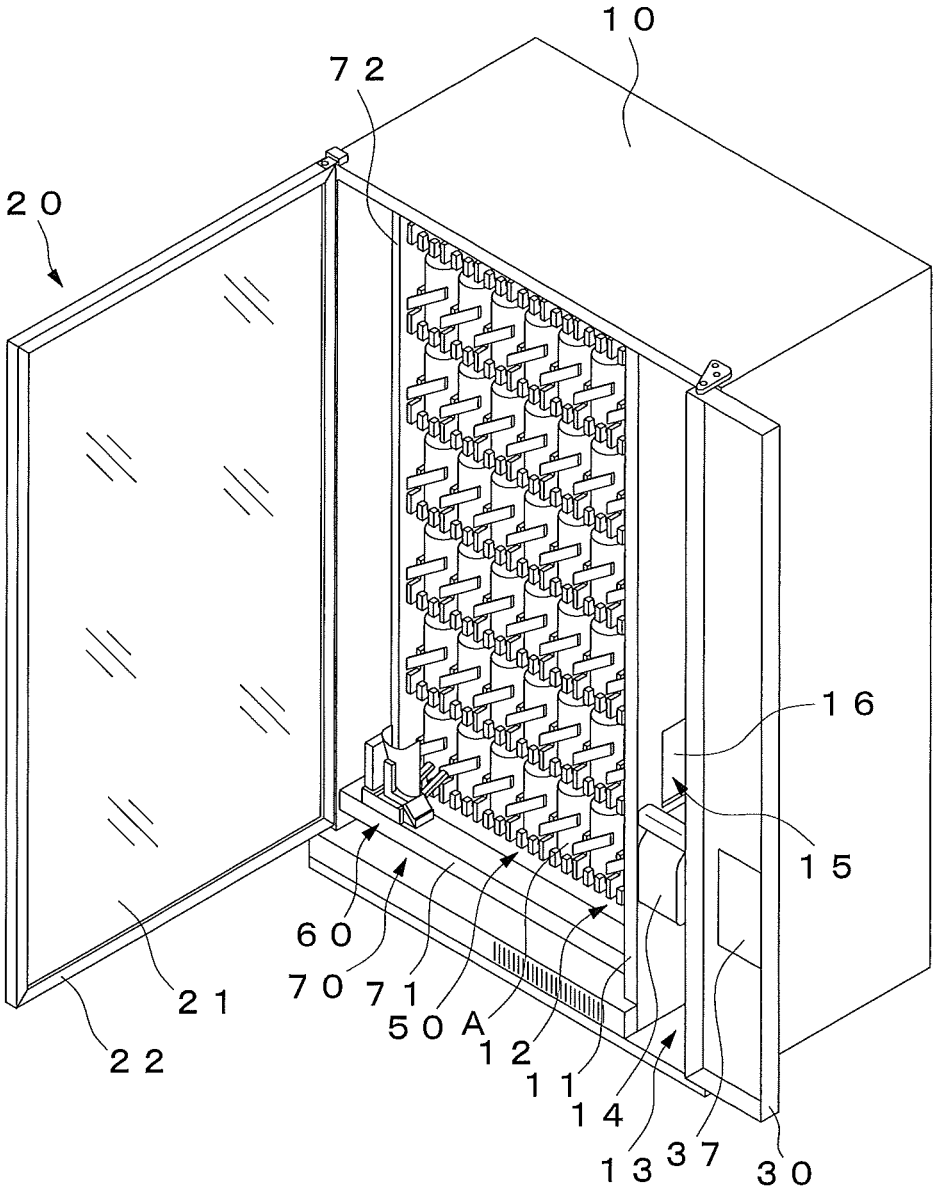
FIG. 2 is a perspective view of the vending machine with a front thereof being opened.
Figure 3:
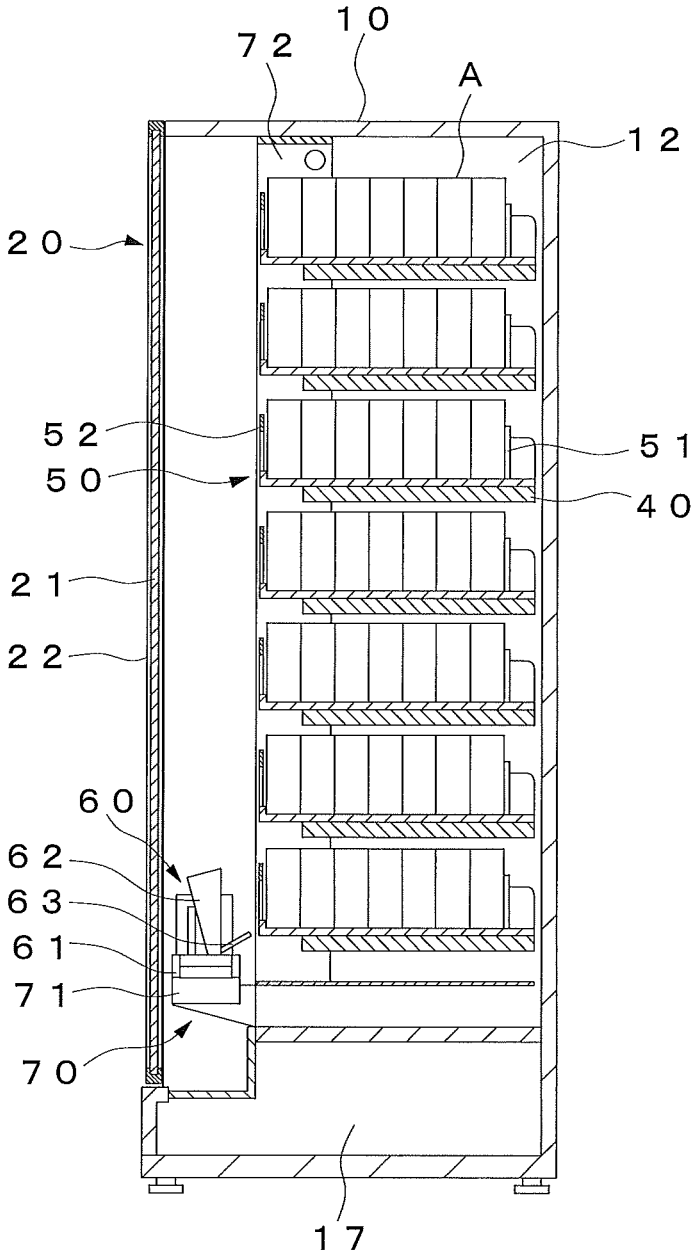
FIG. 3 is a side cross-sectional view of the vending machine.
Figure 4:
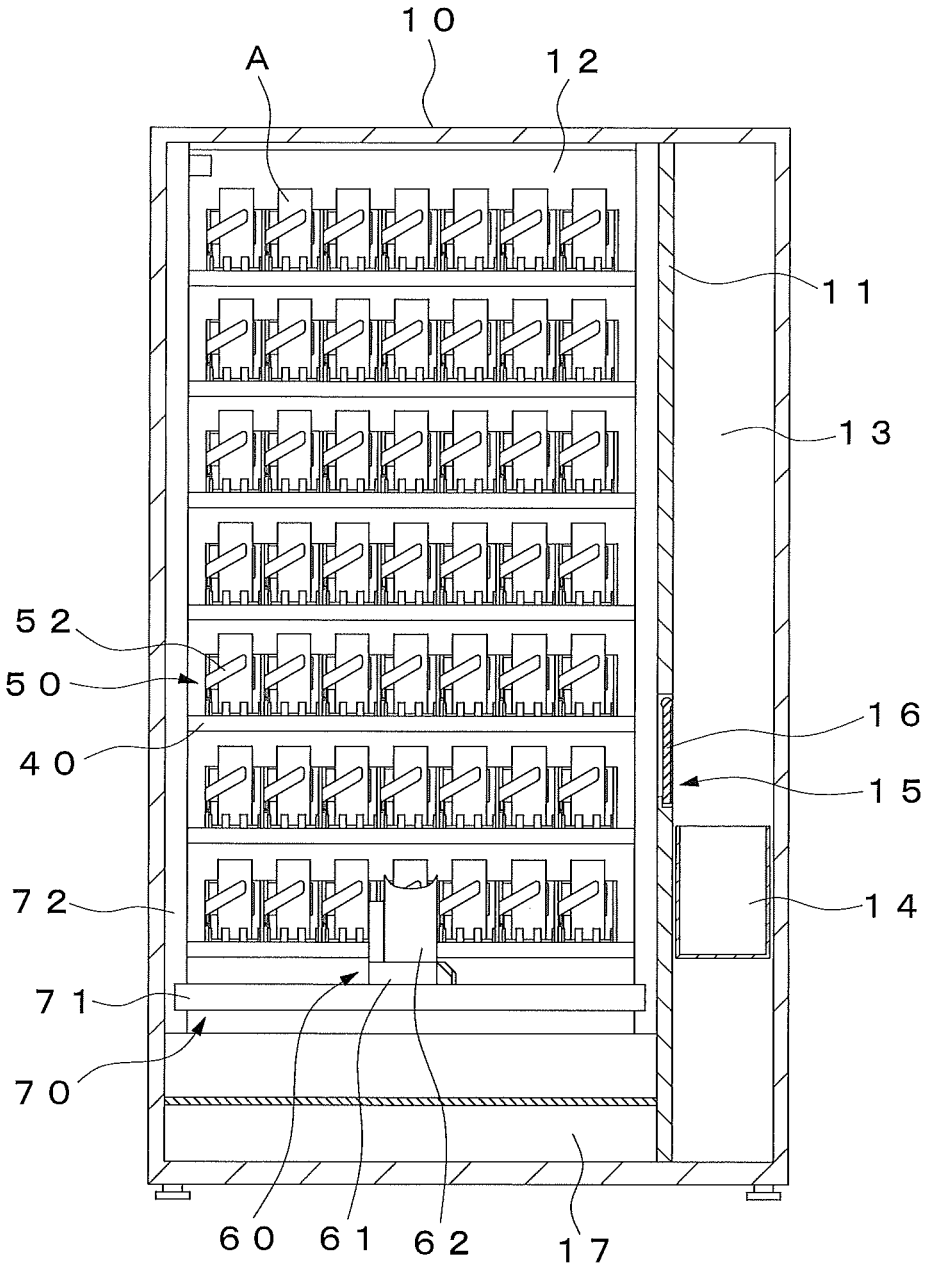
FIG. 4 is a front cross-sectional view of the vending machine.
Figure 5:
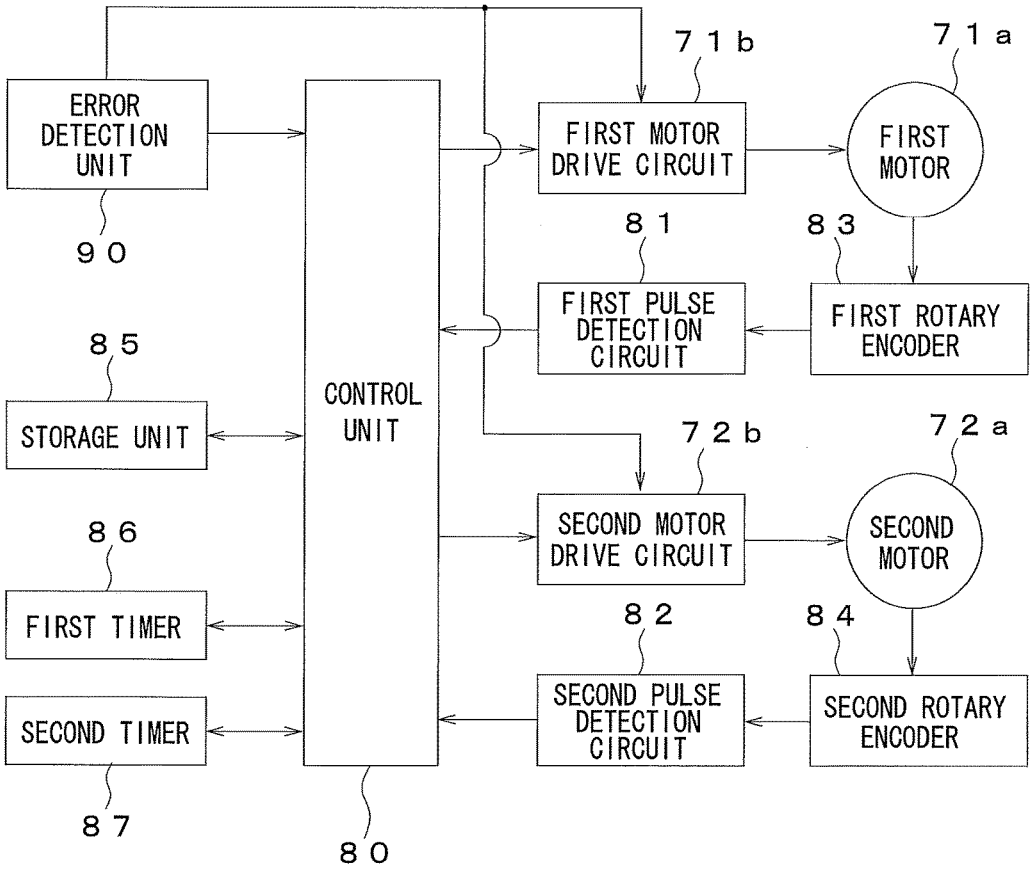
FIG. 5 is a block diagram illustrating a control system.

FIGS. 1 to 6 illustrate an embodiment of the present invention. This vending machine includes a vending machine body 10 with a front thereof being opened; an outer door 20 for opening and closing one end side in a width direction of an opening portion of the vending machine body 10; and an operation door 30 for opening and closing the other end side in the width direction of the opening portion of the vending machine body 10.

The vending machine body 10 includes a commodity storage 12 for storing a commodity A for vending and a device storage 13 for storing a device for performing a vending operation, in which the commodity storage 12 and the device storage 13 are partitioned from each other in the width direction by a partition wall 11. A lower portion of the device storage 13 has a commodity take-out port 14 for delivering the commodity A; and the partition wall 11 has an opening portion 15 for communicating between the commodity take-out port 14 and the commodity storage 12. The opening portion 15 has a delivery door 16. An upper side of the delivery very door 16 is rotatably supported on the opening portion 15. The commodity storage 12 can be cooled or heated by unillustrated cooler or electric heater. A lower portion of the commodity storage 12 has a machine room 17 for storing unillustrated refrigerating equipment such as a compressor and a radiator.

The outer door 20 is rotatably supported on one end side in a width direction of the vending machine body 10 as to open and close the front of the commodity storage 12. The outer door 20 includes a transparent plate 21 made of glass, synthetic resin, or the like; and a frame member 22 provided on an outer peripheral portion of the transparent plate 21 so that the inside of the commodity storage 12 is visible from outside.

The operation door 30 is rotatably supported on the other end side in the width direction of the vending machine body 10 so as to open and close the front of the device storage 13. The front of the operation door 30 includes a coin insertion slot 31, a return lever 32, a money amount display unit 33, a bill insertion slot 34, a commodity selection unit 35, a coin return opening 36, and a commodity take-out port 37.

The commodity storage 12 includes a plurality of commodity columns 50 each arranged vertically in a width direction on a plurality of shelves 40; a bucket 60 as a commodity receptacle for delivering a commodity A stored in the commodity column 50 to the commodity take-out port 14; and a bucket moving mechanism 70 for moving the bucket 60 in the width direction and the vertical direction of the commodity storage 12.

Each commodity column 50 is formed to extend in a front-back direction thereof so as to arrange and store commodities A such as canned, bottled and PET bottled beverages in the front-back direction. Each commodity column 50 has an extrusion plate 51 provided movably in the front-back direction to push the stored commodity A forward from the back side such that the extrusion plate 51 is biased forward by a biasing member such as an unillustrated spiral spring. The front end side of each commodity column 50 has a gate member 52 that is opened or closed by the operation of the bucket 60 and the bottom thereof is cut away so as to allow a fork member 63 of the bucket 60 to pass vertically therethrough as described later. Each commodity column 50 is provided so as to be drawable forward such that the commodity A can be replenished in a forward drawn state.

The bucket 60 includes a base 61 connected to a bucket moving mechanism 70; a bucket body 62 provided movably in the front-back direction relative to the base 61; and a fork member 63 supporting a lower surface of the commodity A, in which the bucket body 62 is rotatable provided in a range of 90° between a side of the commodity column 50 and a side of commodity take-out port in a horizontal direction thereof on the base 61. The fork member 63 is supported on a lower end of the bucket body 62.

The bucket moving mechanism 70 includes a first moving mechanism 71 for moving the bucket 60 in the width direction; and a second moving mechanism 72 for moving the first moving mechanism 71 together with the bucket 60 in the vertical direction. The first and second moving mechanisms 71 and 72 are provided on the front side of the commodity storage 12 each including an unillustrated mechanism for converting rotary motion such as by a belt and pulley, a chain and sprocket, a rack and pinion, or a feed screw mechanism, to linear motion. In this case, the first moving mechanism 71 and second moving mechanism 72 are configured to be driven by a first motor 71*a* and a second motor 72*a* each constituted by a pulse motor. The bucket moving mechanism 70 also has a limit switch 73 for detecting that the first moving mechanism 71 has reached the lowest point.

The vending machine also has a control unit 80 for controlling the operation of the bucket 60 and the bucket moving mechanism 70; and an error detection unit 90 for detecting a predetermined error during the vending operation.

The control unit 80 is constituted by a microcomputer and is connected to the first motor 71*a* and the second motor 72*a* through the first motor drive circuit 71*b* and the second motor drive circuit 72*b* respectively. In this case, the control unit 80 is connected to first and second pulse detection circuits 81 and 82 for detecting pulse values of the first and second motors 71*a* and 72*a* respectively. The first and second pulse detection circuits 81 and 82 are configured to output, to the control unit 80, the pulse values of the first and second motors 71*a* and 72*a* detected by first and second rotary encoders 83 and 84 respectively. The control unit 80 is also connected to a storage unit 85 for storing the pulse values; a first timer 86 for measuring a first time t1 to detect the fall velocity of the bucket 60; and a second timer 87 for measuring a second time t2 to generate a braking force. Each of the motor drive circuits 71*b* and 72*b* is constituted by a well-known circuit that switches the rotation direction of each of the motors 71*a* and 72*a* between normal rotation and reverse rotation by reversing the voltage applied to an electrode of each of the motors 71*a* and 72*a* between positive and negative; and stops the rotation of each of the motors 71*a* and 72*a* by holding the electrode of each of the motors 71*a* and 72*a* at the same potential.

The error detection unit 90 is configured such that, for example, when the bucket 60 is to receive the commodity A from the commodity column 50, a commodity detection sensor (unillustrated) provided in the bucket 60 detects an error such as the commodity A is received by the bucket 60 in an incomplete state or the commodity A is not received by the bucket 60 and falls. In this case, when an error is detected, the error detection unit 90 outputs an error detection signal to the control unit 80 and opens a power supply circuit for the first and second motors 71*a* and 72*a* in the first and second motor drive circuits 71*b* and 72*b* to thereby stop power supply to the first and second motors 71*a* and 72*a*.

In the thus configured vending machine, when a user inserts money into the coin insertion slot 31 or the bill insertion slot 34 and operates the commodity selection unit 35 to select a commodity A, the bucket moving mechanism 70 moves the bucket 60 from a predetermined standby position to a front end side of the commodity column 50 in which the selected commodity A is stored. Then, while the bucket body 62 of the bucket 60 is moving rearward relative to the base 61, the fork member 63 is inserted under the commodity A located on the front end side of the commodity column 50; then, when the bucket moving mechanism 70 moves the bucket 60 upward, the fork member 63 lifts the commodity A and the commodity A is received in the bucket body 62. Then, the bucket body 62 moves forward relative to the base 61; and the bucket body 62 and the fork member 63 are rotated to the side of the commodity take-out port 14. Then, the bucket moving mechanism 70 moves the bucket 60 having received the commodity A to a commodity delivery position, the fork member 63 is rotated downward, and the commodity A is delivered from the opening portion 15 to the commodity take-out port. Subsequently, the bucket moving mechanism 70 returns the bucket 60 having delivered the commodity A to the predetermined standby position to end the vending operation. Note that the bucket moving mechanism 70 moves the bucket 60 by controlling the first and second motors 71*a* and 72*a* based on the pulse values detected by the first and second pulse detection circuits 81 and 82 respectively.

When the error detection unit 90 detects an error during the vending operation, the power supply to the first and second motors 71*a* and 72*a* is stopped. As a result, the first and second motors 71*a* and 72*a* enter a free state, and thus the second motor 72*a* of the second moving mechanism 72 is idly rotated by the first moving mechanism 71 of the bucket moving mechanism 70 and due to the weight of the bucket 60, resulting in that the bucket 60 falls together with the first moving mechanism 71. At this time, the control unit 80 performs the following operations.

Figure 6:
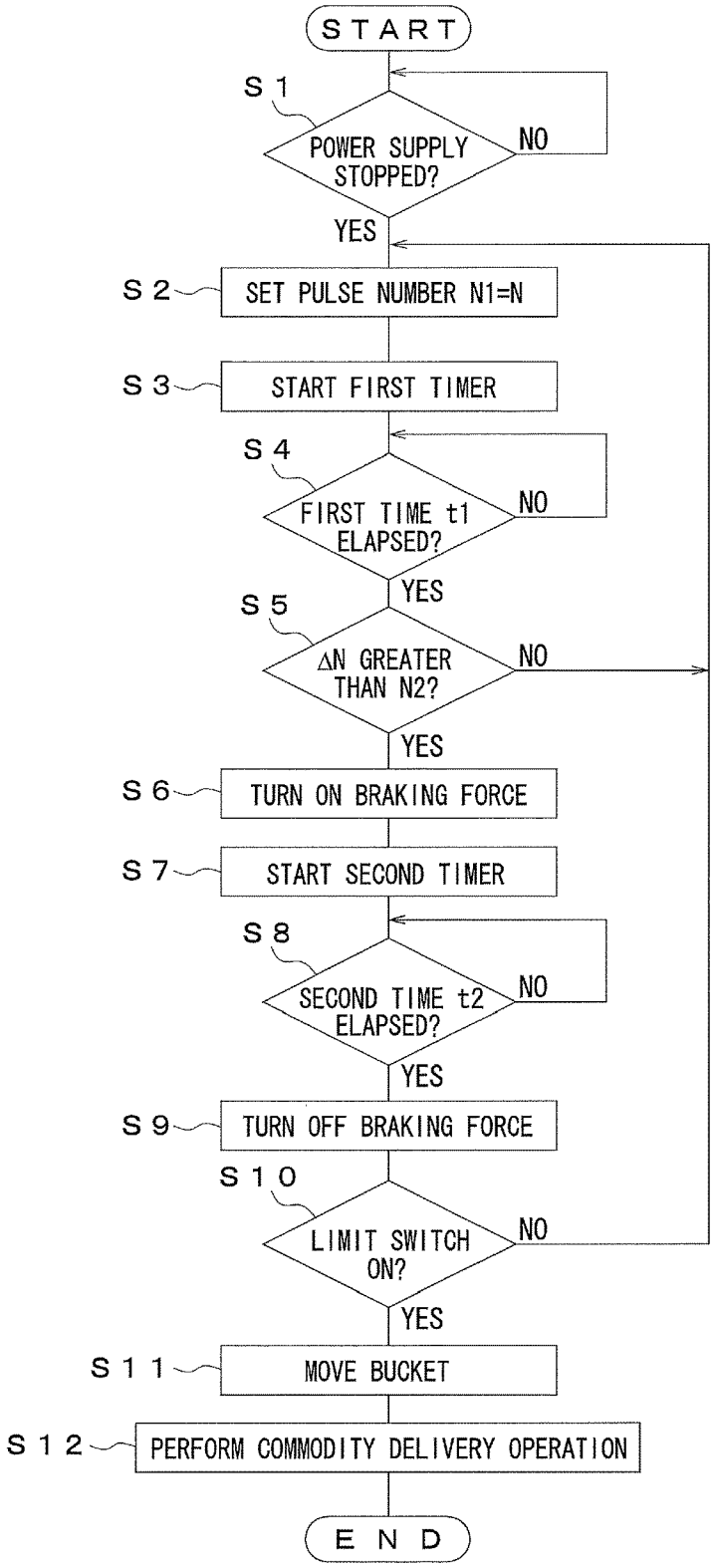
FIG. 6 is a block diagram illustrating an operation of a control unit.

Specifically, as illustrated by a flowchart in FIG. 6, when an error detection unit 90 detects an error and the power supply to the first and second motors 71*a* and 72*a* is stopped (S1), the control unit 80 stores a pulse value N of the second motor 72*a* at that time as an initial value N1 in the storage unit 85 (S2). Here, if the bucket 60 continues to free fall, the pulse value N detected by the pulse detection circuit 81 increases. Then, the first timer 86 is reset to start measuring the first timer 86 (S3); and after a predetermined first time t1 (e.g., 100 ms) has elapsed (S4), if the change amount ΔN (difference between the pulse value N and the initial value N1) of the pulse value N at that time is equal to or less than a predetermined set value N2 (S5), the control unit 80 returns to step S2 and repeats the operations of steps S2 to S5. In other words, the fall velocity detection means is configured by detecting a change in the pulse value N of the second motor 72*a* as the fall velocity of the bucket 60. If the change amount ΔN of the pulse value is greater than the set value N2 in step S5, the second motor drive circuit 72*b* sets the electrode of the second motor 72*a* at the same potential, thereby generating a braking force for decelerating the fall velocity of the bucket 60 (S6). In other words, the braking force generating means is configured such that the second motor 72*a* generates a force for stopping the rotation as a braking force by holding the electrode of the second motor 72*a* at the same potential. Then, the second timer 87 is reset to start measuring by the second timer 87 (S7); and after a predetermined second time t2 (e.g., 100 ms) has elapsed (S8), the second motor drive circuit 72*b* sets the second motor 72*a* to a free state to release the braking force (S9). Here, if the bucket 60 does not reach the lowest point and the limit switch 73 is in an off state (S10), the control unit 80 returns to step S2 and repeats the operations of steps S2 to S10. Thereby, the braking force by the second motor 72*a* is intermittently generated and the bucket 60 falls at a speed slower than free fall. Then, when the bucket 60 reaches the lowest point and the limit switch 73 is turned on in step S10, the bucket moving mechanism 70 moves the bucket 60 to the commodity delivery position (S11), and the bucket 60 performs a commodity delivery operation to the commodity take-out port 14 (S12) and suspends the vending operation. Thus, for example, even if the commodity A is placed in the bucket 60 in an incomplete state, as long as the commodity A is received by the bucket 60 in a deliverable state, the commodity A is delivered to the commodity take-out port 14.

Thus, according to the vending machine of the present embodiment, when it is detected that the fall velocity of the bucket 60 falling due to disconnection of power supply to the second motor 72*a* of the bucket moving mechanism 70 is equal to or greater than the predetermined speed, a braking force for decelerating the fall velocity of the bucket 60 is intermittently generated and thus the bucket 60 can be lowered to the lowest point at a speed slower than free fall. Thus, the vending machine of the present embodiment has an advantage of preventing the bucket 60 from being damaged and a commodity from slipping out thereof by a shock due to falling without requiring a complicated structure for preventing the bucket 60 from undergoing free fall. In addition, the vending machine of the present embodiment, also has an advantage in that the bucket 60 is not locked and thus the bucket 60 can be manually moved during maintenance work for restarting the vending operation, thereby preventing workability from being reduced.

In this case, a change in the pulse value N of the second motor 72*a* is detected as the fall velocity of the bucket 60; and when the change amount ΔN of the pulse value N is greater than the predetermined change amount N2 (predetermined fall velocity), a braking force is assumed to be generated; and thus the free fall of the bucket 60 can be detected by the second pulse detection circuit 82 and the second rotary encoder 84 for use in normal vending operation, thus providing an advantage of eliminating the need to separately provide another device for detecting the fall velocity.

The second motor 72*a* is assumed to generate a force for stopping the rotation as a braking force by holding the electrode of the second motor 72*a* at the same potential, thus providing an advantage of eliminating the need to separately provide another device for generating the braking force.

Further, when the bucket 60 falling in a state of being granted the braking force reaches the lowest point, the bucket moving mechanism 70 moves the bucket 60 to the commodity take-out port 14 to allow the bucket 60 to perform a commodity delivery operation to the commodity take-out port 14. For example, even if an error is detected, as long as the commodity A is received by the bucket 60 in a deliverable state, the commodity A can be delivered to the commodity take-out port 14 and thus the commodity A can be dispensed to the user before suspending the vending operation.

Note that the embodiment has described that a change in the pulse value N of the second motor 72*a* is detected as the free fall of the bucket 60, but for example, a fall velocity detection means having another configuration may be used such as including a speed sensor, a position sensor or the like.

In addition, the embodiment has described that the second motor 72*a* generates a force for stopping the rotation as a braking force by holding the electrode of the second motor 72*a* at the same potential, but for example, a braking force generating means having another configuration may be used, such as a governor including a mechanical brake that generates a braking force when exceeding a predetermined rotational speed. The use of such a mechanical braking force generating means allows the braking force to be controlled according to the fall velocity of the bucket 60 without providing a special control circuit.

Furthermore, the embodiment has described that the second time t2 is set as a time to generate the braking force, but an appropriate braking force can always be generated according to the fall velocity of the bucket 60, for example, by changing the second time t2 according to the change amount ΔN of the pulse value N, such as when the change amount ΔN of the pulse value N is large, the second time t2 is set longer.

Still furthermore, the embodiment has described that regardless of the position of the bucket 60 at the time of error detection, when the change amount ΔN of the pulse value N is greater than the predetermined change amount N2, the braking force is always generated. However, when the bucket 60 is located in a position less susceptible to a shock due to falling without generating such a braking force (e.g., a position of a lower commodity column 50), a control of generating the braking force may be set so as to not be performed.

Note that the embodiment has described that the braking force obtained by holding the electrode of the second motor 72*a* at the same potential is intermittently generated for each second time t2. But if the braking force does not stop the bucket 60 before reaching the lowest point, the braking force may be set so as to be continuously generated.

REFERENCE SIGNS LIST

10 . . . vending machine body
50 . . . commodity column
60 . . . bucket
70 . . . bucket moving mechanism
72*a* . . . second motor
80 . . . control unit
A . . . commodity

The invention claimed is:

1. A vending machine configured to perform a vending operation, the vending machine comprising:

a plurality of commodity columns arranged in a vertical direction of a vending machine body;

a commodity receptacle for receiving a commodity from at least one of the plurality of commodity columns;

a moving mechanism that moves the commodity receptacle in the vertical direction by a motor, wherein, during the vending operation:

the moving mechanism moves the commodity receptacle to any of the plurality of commodity columns, the commodity receptacle receives the commodity from the at least one of the plurality of commodity columns, the moving mechanism moves the commodity receptacle having received the commodity to a commodity take-out port, and the commodity is delivered to the commodity take-out port from the commodity receptacle;

a fall velocity detector configured to detect a fall velocity of the commodity receptacle falling in response to an error in the vending operation due to disconnection of power supply to the motor of the moving mechanism;

a brake configured to generate a braking force to decrease the fall velocity of the commodity receptacle; and a control unit comprising at least one processor, the control unit configured to cause the brake to intermittently or continuously generate the braking force when the fall velocity detector detects that the fall velocity of the commodity receptacle is equal to or greater than a predetermined speed.

2. The vending machine according to claim 1, wherein the motor is constituted by a pulse motor;

the fall velocity detector is configured to detect a change in a pulse value of the motor as a fall velocity of the commodity receptacle; and the control unit is configured such that, when a change amount of the pulse value of the motor is greater than a predetermined change amount, the brake generates a braking force.

3. The vending machine according to claim 1, wherein the brake is configured such that the motor generates a force for stopping the rotation as a braking force.

4. The vending machine according to claim 1, further comprising a position detector configured to detect that the commodity receptacle has reached a lowest point, the vending machine being configured such that, when the position detector detects that the commodity receptacle has reached the lowest point, the moving mechanism moves the commodity receptacle to the commodity take-out port, and the commodity receptacle performs a commodity delivery operation to the commodity take-out port.

5. The vending machine according to claim 2, wherein the brake is configured such that the motor generates a force for stopping the rotation as a braking force by holding an electrode of the motor at the same potential.

6. The vending machine according to claim 2, further comprising a position detector configured to detect that the commodity receptacle has reached the lowest point, the vending machine being configured such that, when the position detector detects that the commodity receptacle has reached the lowest point, the moving mechanism moves the commodity receptacle to the commodity take-out port, and the commodity receptacle performs a commodity delivery operation to the commodity take-out port.

7. The vending machine according to claim 3, further comprising a position detector configured to detect that the commodity receptacle has reached the lowest point, the vending machine being configured such that, when the position detection means detects that the commodity receptacle has reached the lowest point, the moving mechanism moves the commodity receptacle to the commodity take-out port, and the commodity receptacle performs a commodity delivery operation to the commodity take-out port.

* * * * *